US007434557B2

(12) United States Patent
Sailer et al.

(10) Patent No.: US 7,434,557 B2
(45) Date of Patent: Oct. 14, 2008

(54) HYDRAULIC VALVE CLEARANCE COMPENSATION ELEMENT

(75) Inventors: Peter Sailer, Erlangen (DE); Oliver Schnell, Veitsbronn (DE)

(73) Assignee: Schaeffler KG, Herzogenaurach (DE)

( * ) Notice: Subject to any disclaimer, the term of this patent is extended or adjusted under 35 U.S.C. 154(b) by 132 days.

(21) Appl. No.: 11/632,811

(22) PCT Filed: Jun. 18, 2005

(86) PCT No.: PCT/EP2005/006590

§ 371 (c)(1),
(2), (4) Date: Jan. 18, 2007

(87) PCT Pub. No.: WO2006/010413

PCT Pub. Date: Feb. 2, 2006

(65) Prior Publication Data

US 2008/0072857 A1 Mar. 27, 2008

(30) Foreign Application Priority Data

Jul. 22, 2004 (DE) ..... 10 2004 035 588

(51) Int. Cl.
*F01L 1/14* (2006.01)

(52) U.S. Cl. ..... 123/90.48; 123/90.45; 123/90.52; 123/90.55

(58) Field of Classification Search ..... 123/90.44, 123/90.45, 90.46, 90.48, 90.52, 90.55
See application file for complete search history.

(56) References Cited

U.S. PATENT DOCUMENTS 4,054,109 A 10/1977 Herrin
5,159,907 A 11/1992 Budde
5,860,399 A * 1/1999 Speil et al. ..... 123/90.57

FOREIGN PATENT DOCUMENTS

DE 37 08777 A1 10/1987

(Continued)

*Primary Examiner*—Ching Chang
(74) *Attorney, Agent, or Firm*—Charles A. Muserlian

(57) ABSTRACT

A hydraulic reverse spring valve clearance compensation element (RSHVA) for a valve train of an internal combustion engine comprising:

a housing (2), which has a blind bore (3), in which a piston (4) is guided with a tight, sealing clearance;

the piston (4) comprises a lower piston part (4*a*) with a lower piston head (5), which together with the blind bore (3) defines a high-pressure chamber (7), whilst a low-pressure chamber (8) is situated above the lower piston head (5);

the pressure chambers (7, 8) being connected by a central axial bore (10) in the lower piston head (5), which is controlled by a control valve (11) arranged on the underside (23) of the lower piston head (5);

the control valve (11) comprises a control valve ball (19), upon which a control valve spring (20) acts in the opening direction and the lift of which is limited by a lift-limiting stop (24) of a valve ball cap (21), whereby an RSHVA, the idle lift of which is as independent as possible of the viscosity and hence of the temperature of the lubricating oil is to be created and is achieved in that temperature-sensitive means influencing the closing time of the control valve (11) are provided, which lead to a closing time of the control valve (11) that is largely independent of the lubricating oil temperature of the internal combustion engine.

9 Claims, 3 Drawing Sheets

FOREIGN PATENT DOCUMENTS

| | | | |
|---|---|---|---|
| DE | 40 31 232 | A1 | 4/1992 |
| DE | 41 07 041 | A1 | 9/1992 |
| DE | 694 10 143 | T2 | 2/1994 |
| DE | 698 19 378 | T2 | 1/1998 |
| EP | 1 298 287 | A2 | 4/2003 |
| JP | 61 185607 | | 8/1986 |
| JP | 61 286509 | A | 12/1986 |
| JP | 11 148318 | | 6/1999 |

* cited by examiner

HYDRAULIC VALVE CLEARANCE COMPENSATION ELEMENT

This application is a 371 of PCT/EP2005/006590 filed Jun. 18, 2005.

FIELD OF THE INVENTION

The invention relates to a hydraulic reverse spring valve clearance compensation element (abbreviation: RSHVA) for the valve train of an internal combustion engine, in particular according to the preamble of patent claim 1.

BACKGROUND OF THE INVENTION

Hydraulic valve clearance compensation elements serve to compensate for the clearance which, due to wear or thermal expansion, forms between the transmission elements transmitting the cam lift to the gas exchange valves of the internal combustion engine. The intention is to achieve a quiet and wear-resistant valve train and the greatest possible conformity between the cam lobe and the valve lift.

Hydraulic valve clearance compensation elements have a control valve in the form of a non-return valve, which comprises a control valve ball and a control valve spring acting thereon. In the standard type of control valve the control valve spring acts on the control valve ball in the closing direction. This largely closes the control valve and there is no idle lift of the valve clearance compensation element. There is even a risk of pumping up the compensation element and of a negative valve clearance.

These disadvantages are avoided by control valves, the control valve spring of which acts upon the control valve ball in the opening direction. Because of the reversed arrangement of the control valve spring, hydraulic valve clearance compensation elements comprising such a control valve are referred to as hydraulic reverse spring valve compensation elements (RSHVA). These have a positive influence on the thermodynamics, the pollutant emissions and the mechanical stressing of the internal combustion engine and are therefore being increasingly used.

In the standard design type, the control valve is largely closed in the base circle area of the cam owing to the force of the control valve spring. In an RSHVA the control valve in this area is kept open by the force of the control valve spring. Since the RSHVA can only be closed by the hydrodynamic and hydrostatic forces due to the flow of lubricating oil commencing at the beginning of the cam lobe and flowing from the high-pressure chamber to the low-pressure chamber, the RSHVA always has an idle lift before the valve lift commences. The extent of the idle lift at any engine speed depends on the length of the RSHVA closing time and this in turn depends on the viscosity of the lubricating oil.

To close the control valve of an RSHVA, a so-called critical lubricating oil velocity is required. This varies as a function of the lubricating oil viscosity and hence of the lubricating oil temperature. At high lubricating oil viscosity, that is to say at low lubricating oil temperatures, the critical lubricating oil velocity is lower and is therefore attained more rapidly than at low lubricating oil viscosity, that is to say high lubricating oil temperatures. In cold starting this leads to a shorter closing time of the control valve and hence to a smaller idle lift than in the engine at operating temperature. A small idle lift means a large valve overlap, however. This results in a large internal exhaust gas recirculation, which causes an uneven, low idling. Although this can be improved by increasing the idling speed, this is achieved at the expense of the pollutant emissions and the fuel consumption.

The generic EP 1 298 287 A2 discloses an RSHVA for the valve train of an internal combustion engine, which is characterized by the following features:

- a housing, which has a blind bore, in which a piston is guided with a tight, sealing clearance;
- the piston comprises a lower piston part with a lower piston head, which together with the blind bore defines a high-pressure chamber, whilst a low-pressure chamber is situated above the lower piston head;
- the pressure chambers are connected by means of a central axial bore in the lower piston head, which is controlled by a control valve arranged on the underside of the lower piston head;
- the control valve comprises a control valve ball, upon which a control valve spring acts in the opening direction and the lift of which is limited by a lift-limiting stop of a valve ball cap.

This published patent application focuses on the optimum design for the control valve spring of the RSHVA. The design is selected so that the control valve is open in order to facilitate fitting of the RSHVA in said valve and so that it allows an exchange of fluid between the high-pressure chamber and the low-pressure chamber, but in the event of a pressure rise in the high-pressure chamber will permit a rapid closing of the control valve against the spring force of the control valve spring.

The influence of the lubricating oil temperature on the closing time of the control valve and hence on the idle lift of the RSHVA does not form the subject matter of this published patent application.

U.S. Pat. No. 4,054,109 describes an RSHVA, the features of which largely correspond to those of EP 1 298 287 A2. This patent specification focuses on a valve lift that increases with the engine speed. This increases inversely with a reduction in the idle lift of the RSHVA. The start of the valve lift depends on the attainment of a specific rate of lift of the valve-actuating cam, which serves to close the control valve. Since the required rate of lift is attained ever earlier as the engine speed increases, the valve lift becomes correspondingly greater as the engine speed increases, whereas the idle lift of the RSHVA correspondingly diminishes.

This specification also fails to mention any influence of the lubricating oil temperature on the idle lift, closing time and valve overlap.

The Japanese published patent application 61 185 607 A discloses an RSHVA which in construction and function approximates to U.S. Pat. No. 4,054,109. In contrast to the latter, the reverse spring of the Japanese application takes the form of a disk spring rather than a helical coil spring. In this application, too, the idle lift of the RSHVA diminishes with increasing engine speed, and the lift of the gas exchange valves and hence the engine power output diminish correspondingly. The smaller valve lift at low engine speeds is intended to reduce the fuel consumption.

In this specification, too, no reference of any kind is made to the lubricating oil temperature exerting an influence on closing time of the control valve and the idle lift of the RSHVA.

OBJECT OF THE INVENTION

The object of the invention is to create an RSHVA, the idle lift of which is as independent as possible of the viscosity and hence of the temperature of the lubricating oil.

SUMMARY OF THE INVENTION

According to the invention the object is achieved by the features of the independent device claim 1.

The aim of adjusting the idle lift of the RSHVA throughout the entire lubricating oil temperature range to the idle lift at operating temperature presupposes means which react to the lubricating oil temperature and exert the corresponding influence on the closing time of the control valve and hence on the idle lift of the RSHVA. Such means are disclosed in the following dependent claims.

A first means in the form of a round metal disk (a so-called thermo-snap disk), which serves as support for the control valve spring, is advantageous. When the lubricating oil temperature falls below a specific temperature, an abrupt deformation of the metal disk occurs, which leads to an increased tensioning of the control valve spring. This increases the closing time of the control valve to the value usual at operating temperature. If the specific lubricating oil temperature is exceeded, the metal disk drops back into its initial position again, so that the tension of the control valve spring returns to the optimized value for the operating temperature.

For the working of the thermo-snap disk it is advantageous for the lower piston head, on its inner side, to have a shallow, conical depression, on the outer area of which the round metal disk rests, and the conical area of which affords the requisite space for the deformed, round metal disk. Since the deformation values involved in deformation of the thermo-snap disk are only small, a shallow conical countersinking of the piston head is sufficient to create the required freedom of movement for the metal disk.

The functional reliability of the metal disk is ensured in that a cylindrical inner wall of the lower piston part has a radial groove, which is tangent to the conical depression of the lower piston head and in which a retaining ring can be snapped for axial fixing of the metal disk without any play. The radial groove is designed so that the retaining ring fits into said groove without axial play, at the same time exerting an axial clamping force on the outer edge of the metal disk.

The central bore in the metal disk allows the flow of lubricating oil between the high-pressure chamber and the low-pressure chamber. Its diameter is smaller than the inside diameter of the control valve spring, which in this way is provided with a secure seat.

A further possible way of influencing the idle lift of the valve clearance compensation element is to use a memory alloy for the reverse spring. Its spring rigidity increases up to a specific temperature and makes it increasingly difficult for the control valve to close. Its closing time thereby increases to the values of a conventional control valve spring at engine operating temperature. In this way, an idle lift of the valve clearance compensation element that is largely independent of the lubricating oil temperature and hence a largely constant, small valve overlap is achieved, which leads to a uniform low idling.

Another advantageous means of influencing the closing time of the control valve is a magnet, which serves as lift-limiting stop for the control valve ball and the attractive force of which acting on the control valve ball increases with diminishing lubricating oil temperature. The effort needed to release the control valve ball, which increases as the temperature falls, produces a corresponding lengthening of the closing time and thereby an increase in the idle lift of the RSHVA. This means thereby also serves to achieve a small valve overlap, largely independent of the lubricating oil temperature.

A fourth means of influencing the idle lift of the RSHVA is afforded by at least one bimetal element, which is arranged at a minimum of one point on the wall of a central axial bore or a first or second cylindrical widening thereof between the high-pressure chamber and the low-pressure chamber, and which increasingly restricts the lubricating oil flow from the high-pressure chamber to the low-pressure chamber as the lubricating oil temperature falls. This serves to prolong the closing time of the control valve at low lubricating oil temperature and thereby to adjust the idle lift of the RSHVA to the values of the internal combustion engine at operating temperature, so that the valve overlap, here too, remains approximately constant over the entire operating range of the internal combustion engine.

In order to enhance and even out the effect of the temperature-sensitive means influencing the closing time of the control valve, a combination of such means is also feasible.

BRIEF DESCRIPTION OF THE DRAWINGS

Further features of the invention are set forth in the following description and the drawings, in which an example of the invention is represented schematically.

In the drawings.

DETAILED DESCRIPTION OF THE DRAWINGS

Figure 1:
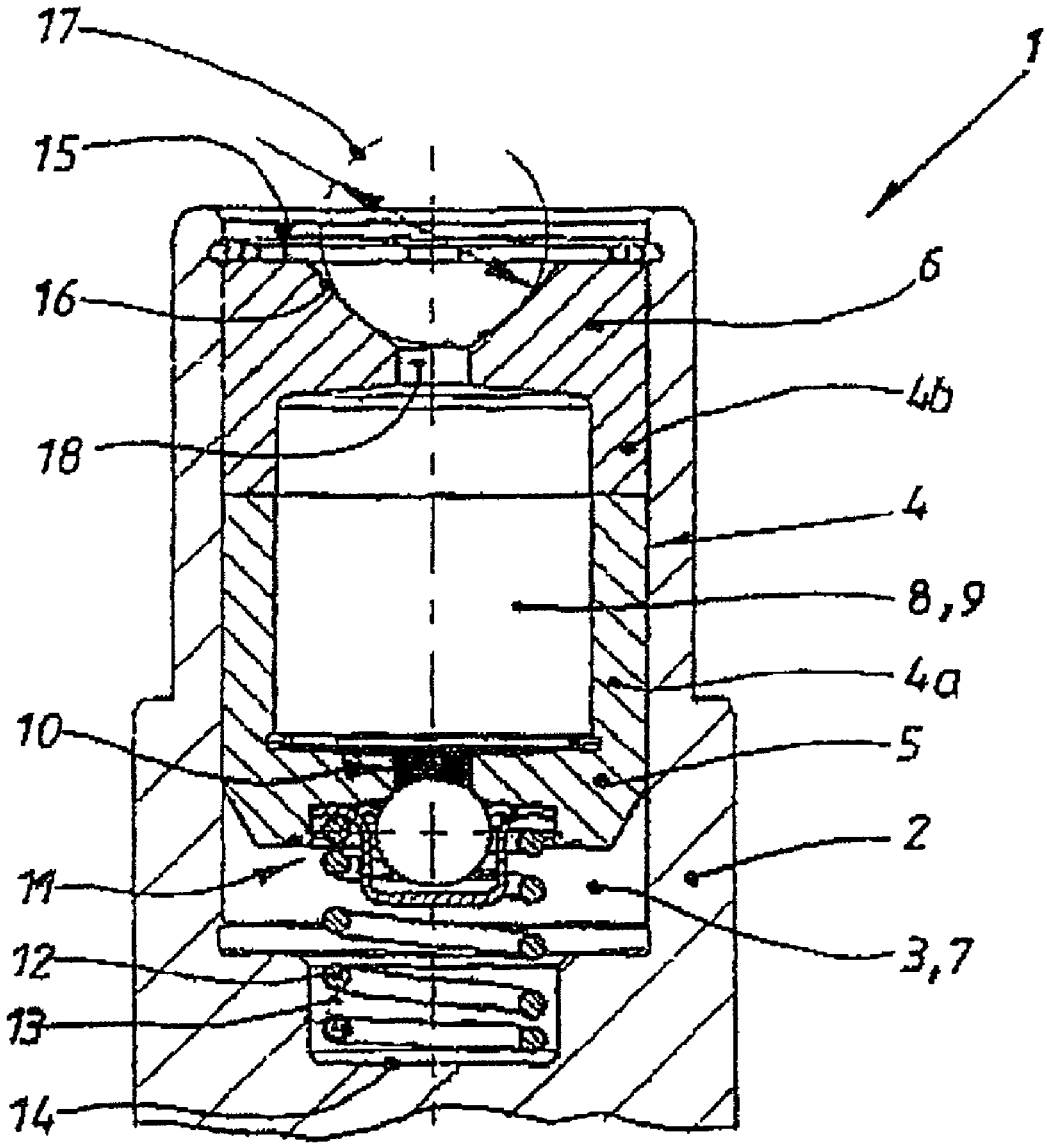
FIG. 1 shows a longitudinal section through an RSHVA with a piston lower part, which comprises a lower piston head with a central axial bore, which is controlled by a control valve, the control valve spring of which is supported on a so-called thermo-snap disk.

FIG. 1 shows a longitudinal section through a hydraulic reverse spring valve clearance compensation element, which takes the form of a roller tappet 1. This has a rotationally symmetrical housing 2 with a roller (not represented) provided at the lower end thereof. The housing 2 has a stepped blind hole 3, in which a piston 4 is guided with a tight, sealing clearance.

The piston 4 is horizontally divided and has a piston lower part 4*a* and a piston upper part 4*b*. The piston lower part 4*a* is terminated by a lower piston head 5 and the piston upper part 4*b* by an upper piston head 6.

Below the lower piston head 5 is a high-pressure chamber 7, which is enclosed by the blind hole 3. A low-pressure chamber 8, which encloses the interior space 9 of the piston 4 and serves as oil reservoir, is arranged above the lower piston head 5.

The high-pressure chamber 7 and low-pressure chamber 8 are connected by a central axial bore 10, which is provided in the lower piston head 5. It is controlled by a control valve 11, which is arranged beneath the lower piston head 5.

The control valve 11 is shown and described in detail with reference to an enlarged representation of the piston 4 in FIG. 2. FIG. 1 shows a compression spring 12, which is supported in a central trough 13 at the bottom 14 of the high-pressure chamber 7 and which exerts pressure on the piston 4 and thereby on the entire valve train.

On its outer face 15 the upper piston head 6 has a central, conical depression 16 for guiding, for example, the ball 17 of a push rod (not shown). Another central axial bore 18 connects the low-pressure chamber 8 to the lubricating oil supply of the valve train.

Figure 2:
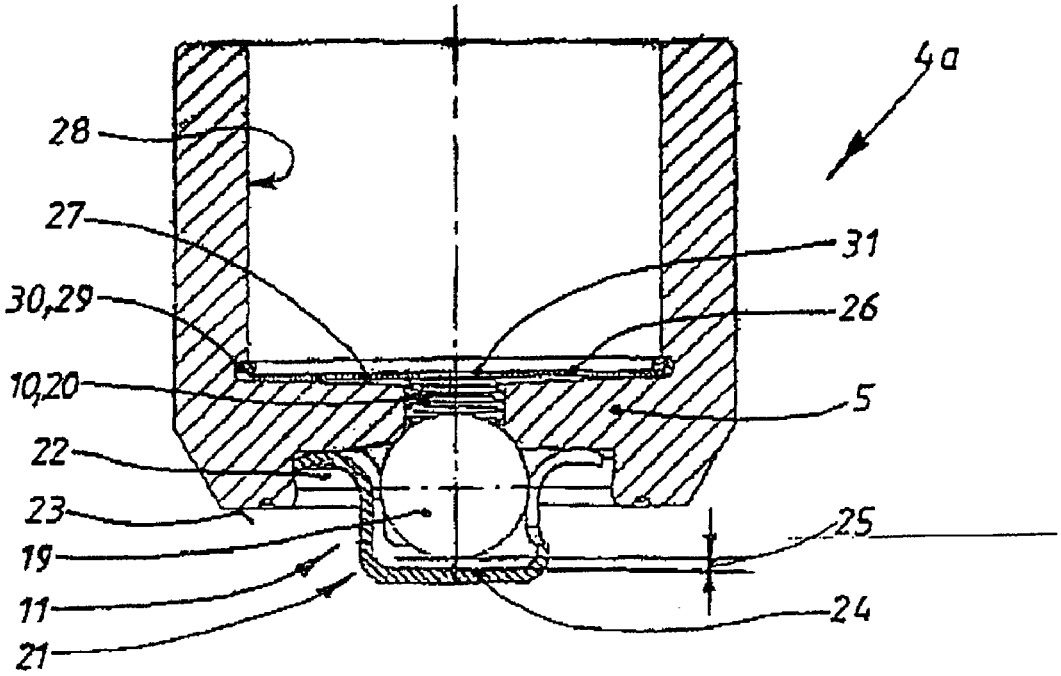
FIG. 2 shows an enlargement of the lower piston part of the RSHVA in FIG. 1.

FIG. 2 represents an enlarged longitudinal section through the piston lower part 4*a*, illustrating the details of the control valve 11. This has a control valve ball 19, on which a control valve spring 20 acts in the opening direction. The control valve ball 19 is guided with lateral clearance by a valve ball cap 21. The valve ball cap 21 is in turn axially and radially guided in another central trough 22, which is let into the underside 23 of the lower piston head 5. It is clipped into the other central trough 22, which is slightly conically recessed, and subjected to pressure by the compression spring 12 represented in FIG. 1. A lift-limiting stop 24 of the valve ball cap 21 limits the lift 25 of the control valve ball 19.

The control valve spring 20 is arranged in the central axial bore 10 and is supported on a circular metal disk 26. When the lubricating oil temperature falls below a specific temperature this so-called thermo-snap disk experiences a reversible deformation, which leads to an increase in the tensioning of the control valve spring 20, thereby increasing the closing time of the control valve 11 and consequently increasing the idle lift of the RSHVA to values associated with the engine at operating temperature.

On its inside the lower piston head 5 has a shallow conical depression 27. Its outer area serves as a seat for the metal disk 26 and its conical area affords the required space for the deformed metal disk 26. The cylindrical inner wall 28 of the piston lower part 4a has a radial groove 29, which is tangent to the conical depression 27 of the lower piston head 5. A retaining ring 30, which serves for axial fixing of the metal disk 26 without any clearance, can be snapped into the radial groove 29.

The metal disk 26 has a central bore 31, the diameter of which is smaller than the inside diameter of the control valve spring 20. The central bore 31 serves for an exchange of lubricating oil between the high-pressure chamber 7 and the low-pressure chamber 8 (see FIG. 1).

Figure 3:
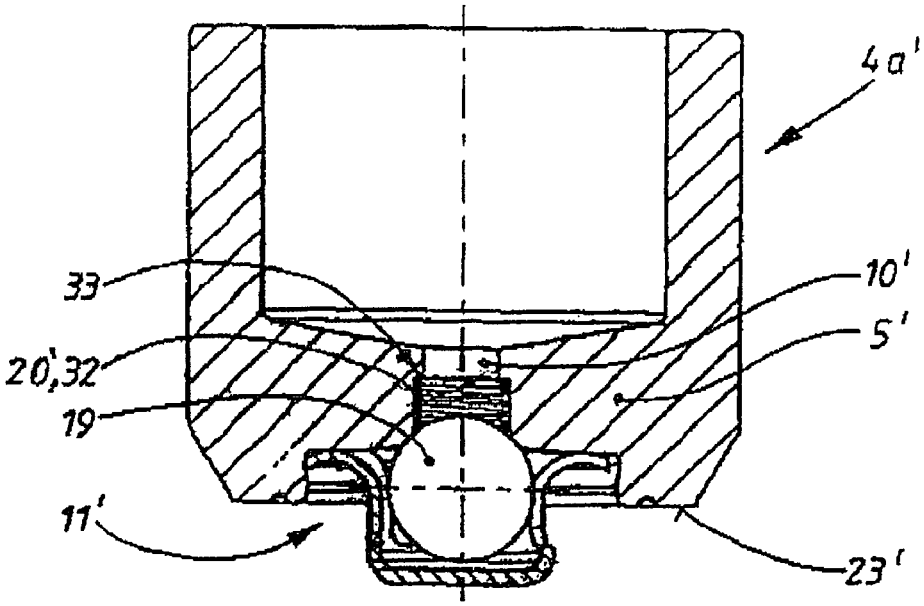
FIG. 3 shows a piston lower part according to FIG. 2, with a control valve, the control valve spring of which, supported on the underside of the piston, is composed of a memory alloy.

FIG. 3 shows a piston lower part 4*a*' having a lower piston head 5' and a control valve 11'. The piston head 5' has a central bore 10' with a cylindrical widening 32 running to the control valve ball 19. In this widening is a control valve spring 20', which is supported on a shoulder 33 of the cylindrical widening 32. The control valve spring 20' is composed of a memory alloy, the spring rigidity of which increases when the lubricating oil temperature falls below a specific temperature. As a result there is an increase in the spring force of the control valve spring 20' and consequently in the closing time of the control valve 11' and the idle lift of the RSHVA. In this way a constant, small valve overlap at idling speed is achieved over the entire temperature range of the internal combustion engine, which leads to a uniform, low idling.

Figure 4:
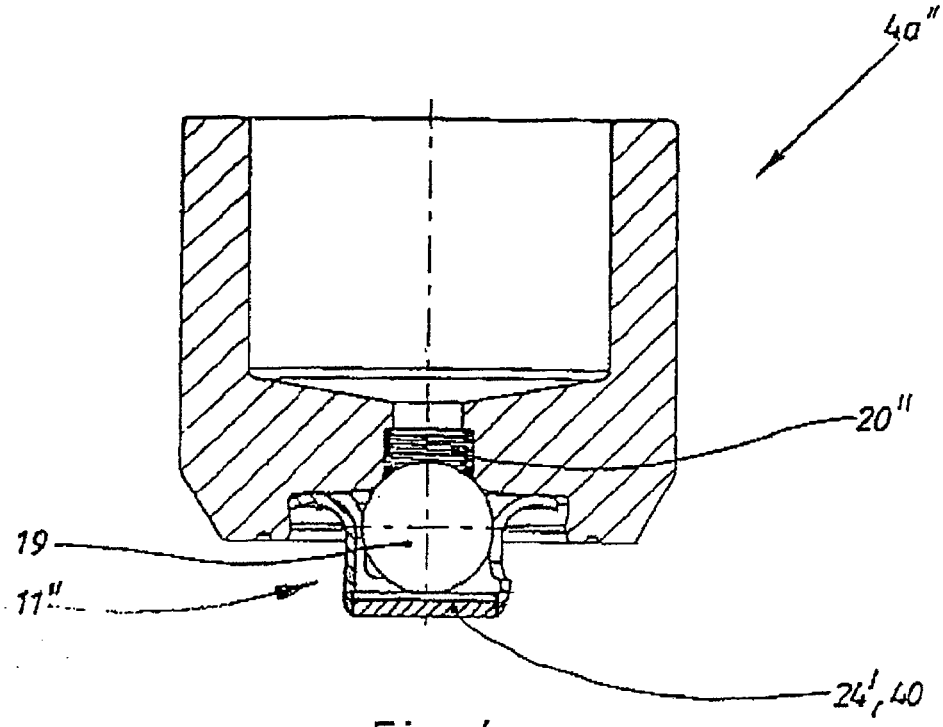
FIG. 4 shows a piston lower part according to FIG. 3 with a control valve, which comprises a conventional control valve spring but has a permanently magnetic lift-limiting stop for the control valve ball.

FIG. 4 represents a piston lower part 4*a*" having a control valve 11", which differs from the control valve 11' of the piston lower part 4*a*' by virtue of a control valve spring 20" and lift-limiting stop 2'. The control valve spring 20" is composed of ordinary spring steel, whilst the lift-limiting stop 24' is a magnet 40, the attractive force of which acting on the control valve ball 19 increases with falling lubricating oil temperature. This compensates for the closing time of the control valve 11", which diminishes as the lubricating oil temperature falls, and adjusts to the closing time of the internal combustion engine at operating temperature. As a result, the idle lift of the RSHVA and hence the valve overlap also remain approximately constant over the entire operating range of the internal combustion engine.

Figure 5:
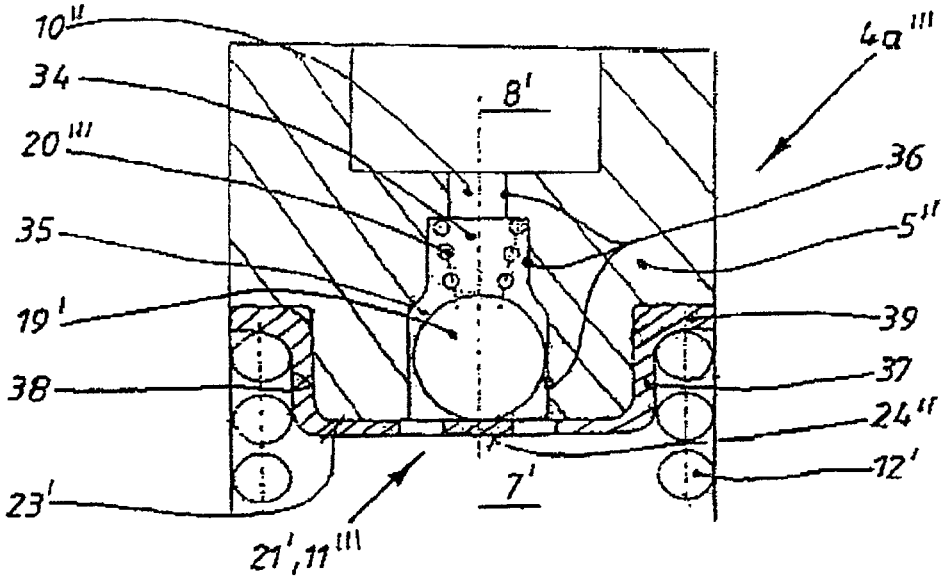
FIG. 5 shows a piston lower part with a lower piston head, in which a control valve is incorporated, which has a central axial bore with a first and second cylindrical widening, on which at least one bimetal element is arranged.

FIG. 5 shows a modified piston lower part 4*a*'" having a control valve 11'" incorporated in a lower piston head 5". The lower piston head 5" separates a high-pressure chamber 7' from a low-pressure chamber 8'. The pressure chambers 7', 8' are connected by a central axial bore 10", which proceeding from the low-pressure chamber 8' has a first cylindrical widening 34 for a control valve spring 20'" and a second cylindrical widening 35 for a control valve ball 19'. A bimetal element 36, which as the lubricating oil temperature falls increasingly restricts the flow of lubricating oil flowing from the high-pressure chamber 7' to the low-pressure chamber 8' in the closing phase, can be arranged on the walls of all three sections 10", 34, 35. This means that as in the case of the means described in FIGS. 1 to 4 there is an increase in the closing time of the control valve and hence in the idle lift of the RSHVA at low lubricating oil temperatures, adjusting it to that prevailing when the internal combustion engine is at operating temperature. In this way an approximately constant valve overlap is obtained over the entire operating range of the internal combustion engine, which likewise results in a uniform overall idling speed.

The lift of the control valve ball 19' is limited by a lift-limiting stop 24", which is part of a ball valve cap 21' This bears on the underside 23' of the lower piston head 5". The ball valve cap 21' has a cylindrical section 37, which is led radially through an outer step 38 of the lower piston head 5" and a flange 39, which is acted upon by a compression spring 12' and is axially fixed, said spring being supported in the high-pressure chamber 7'.

REFERENCE NUMERALS

1 roller tappet
2 housing
3 blind bore
4 piston
4*a*,4*a*',4*a*",4*a*'" piston lower part
4*b* piston upper part
5,5',5" lower piston head
6 upper piston head
7,7' high-pressure chamber
8,8' low-pressure chamber
9 interior space
10,10',10" central axial bore
11,11',11",11'" control valve
12,12' compression spring
13 central trough
14 bottom
15 outer face
16 conical depression
17 ball
18 other central axial bore
19,19' control valve ball
20,20',20",20'" control valve spring
21,21' valve ball cap
22 other central trough
23,23' underside
24,24',24" lift-limiting stop
25 lift
26 metal disk
27 shallow, conical depression
28 cylindrical inner wall
29 radial groove

30 retaining ring
31 central bore
32 cylindrical widening
33 shoulder
34 first cylindrical widening
35 second cylindrical widening
36 bimetal element
37 cylindrical section
38 outer step
39 flange
40 magnet

The invention claimed is:

1. A hydraulic reverse spring valve clearance compensation element (abbreviation: RSHVA) for a valve train of an internal combustion engine comprising:

a housing, which has a blind bore, in which a piston is guided with a tight sealing clearance;

the piston comprises a lower piston part with a lower piston head, which together with the blind bore defines a high-pressure chamber, whilst a low-pressure chamber is situated above the lower piston head;

the pressure chambers are connected by means of a central axial bore in the lower piston head, which is controlled by a control valve arranged on the underside of the lower piston head;

the control valve comprises a control valve ball, upon which a control valve spring acts in the opening direction and the lift of which is limited by a lift-limiting stop of a valve ball cap, wherein temperature-sensitive means influencing the closing time of the control valve are provided, which lead to a closing time of the control valve that is largely independent of the lubricating oil temperature of the internal combustion engine.

2. The RSHVA of claim 1, wherein a first means is a round metal disk, which serves as support for the control valve spring and which when the lubricating oil temperature falls below a specific temperature experiences a reversible deformation, which leads to an increased tensioning of the control valve spring.

3. The RSHVA of claim 2, wherein the lower piston head, on its inner side, has a shallow, conical depression, on the outer area of which the round metal disk rests, and the conical area of which affords the requisite space for the deformed, round metal disk.

4. The RSHVA of claim 3, wherein a cylindrical inner wall of the lower piston part has a radial groove, which is tangent to the conical depression of the lower piston head and in which a retaining ring is snapped for axial fixing of the round metal disk without any play.

5. The RSHVA of claim 4, wherein the round metal disk has a central bore, the diameter of which is smaller than the inside diameter of the control valve spring.

6. The RSHVA of claim 1, wherein a second means is a control valve spring, which is supported on the underside of the piston head of a piston lower part and is composed of a memory alloy, the spring rigidity of which increases when the lubricating oil temperature falls below a specific temperature.

7. The RSHVA of claim 1, wherein a third means in a magnet, which serves as lift-limiting stop for the control valve ball and the attractive force of which acting on the control valve ball increases as the lubricating oil temperature falls.

8. The RSHVA of claim 1, wherein a fourth means is at least one bimetal element, which is arranged at a minimum of one point on the wall of a central axial bore or a first cylindrical widening thereof or a second cylindrical widening thereof between the high-pressure chamber and the low-pressure chamber, and which increasingly restricts the lubricating oil flow from the high-pressure chamber to the low-pressure chamber as the lubricating oil temperature falls.

9. The RSHVA of claim 1, wherein the temperature-sensitive means influencing the closing time of the control valve can be used individually or in any combination.

* * * * *